US011167876B2

(12) United States Patent
Fillion et al.

(10) Patent No.: US 11,167,876 B2
(45) Date of Patent: Nov. 9, 2021

(54) PRESENTATION CONTAINER APPARATUS

(71) Applicants: Julie Marie France Fillion, Surrey (CA); Sheldon David Smith, Vancouver (CA)

(72) Inventors: Julie Marie France Fillion, Surrey (CA); Sheldon David Smith, Vancouver (CA)

( * ) Notice: Subject to any disclaimer, the term of this patent is extended or adjusted under 35 U.S.C. 154(b) by 0 days.

(21) Appl. No.: 16/678,386

(22) Filed: Nov. 8, 2019

(65) Prior Publication Data

US 2020/0148408 A1 May 14, 2020

Related U.S. Application Data

(60) Provisional application No. 62/758,357, filed on Nov. 9, 2018.

(30) Foreign Application Priority Data

Dec. 18, 2018 (CA) ..... 3027897

(51) Int. Cl.
*B65D 5/20* (2006.01)
*B65D 5/42* (2006.01)
(Continued)

(52) U.S. Cl.
CPC ..... *B65D 5/20* (2013.01); *B65D 5/425* (2013.01); *B65D 5/56* (2013.01); *B65D 45/32* (2013.01); *B65D 2313/10* (2013.01)

(58) Field of Classification Search
CPC . B65D 5/20; B65D 5/425; B65D 5/56; B65D 45/32; B65D 5/4262; B65D 2313/02; B65D 25/102; B65D 65/02
(Continued)

(56) References Cited

U.S. PATENT DOCUMENTS 4,562,952 A * 1/1986 Chinman ..... A45C 3/00 206/292
4,614,266 A * 9/1986 Moorhead ..... B65D 79/00 206/216
(Continued)

FOREIGN PATENT DOCUMENTS

CN 2841511 Y 11/2006
CN 201447095 U 5/2010
(Continued)

OTHER PUBLICATIONS

Examiner's Requisition dated Jan. 31, 2020 in connection with Canadian Patent Application No. 3027897.

*Primary Examiner* — Christopher R Demeree
(74) *Attorney, Agent, or Firm* — Norton Rose Fuibright Canada LLP

(57) ABSTRACT

A presentation container comprising a sheet of material comprising a base panel, a wall panel foldably connected to each edge of the base panel, and a lid tab foldably connected to an outer edge of each wall panel, and one or more ribbons attached to the sheet of material. Each wall panel is foldable perpendicular to the base panel such that a side edge of each wall panel is next to each adjacent wall panel, and each lid tab is foldable perpendicular to the associated wall panel to place the container in a constructed form for housing an object in an interior thereof. At least two ends of the ribbons are securable to each other to hold the container in the constructed form, and the container is moveable into a presentation form by unsecuring the at least two ends of the ribbons to display the object.

20 Claims, 6 Drawing Sheets

(51) Int. Cl.
*B65D 45/32* (2006.01)
*B65D 5/56* (2006.01)

(58) Field of Classification Search
USPC ..... 229/116.1, 116.5, 87.19, 923, 125.38, 229/125.22, 125.39; 206/457, 292, 494; 383/4, 86; 53/461
See application file for complete search history.

(56) References Cited

U.S. PATENT DOCUMENTS

| | | | | |
|---|---|---|---|---|
| 5,004,144 | A * | 4/1991 | Selga | B65D 65/06 229/87.19 |
| D365,127 | S | 12/1995 | Westersund | |
| 6,405,869 | B1 * | 6/2002 | Whittemore | B65D 33/004 206/497 |
| 7,000,771 | B2 | 2/2006 | Kwong | |
| 9,365,337 | B2 | 6/2016 | Fullan | |
| D817,771 | S | 5/2018 | Smith | |
| 2009/0114707 | A1 | 5/2009 | Navarre | |
| 2010/0313529 | A1 | 12/2010 | Steinhauser | |
| 2013/0186782 | A1 * | 7/2013 | Doyle | B65D 5/02 206/232 |
| 2013/0186947 | A1 * | 7/2013 | Hohman | B65D 25/16 229/87.19 |

FOREIGN PATENT DOCUMENTS

| | | | |
|---|---|---|---|
| CN | 202016610 | U | 10/2011 |
| CN | 202186625 | U | 4/2012 |
| CN | 103832655 | A | 6/2014 |
| DE | 4405560 | C1 | 12/1994 |
| GB | 2139187 | A | 11/1984 |
| GB | 2312891 | A | 11/1997 |
| JP | 2009007037 | A | 1/2009 |

* cited by examiner

PRESENTATION CONTAINER APPARATUS

CROSS REFERENCE TO RELATED APPLICATIONS

This application is a non-provisional of, and claims all benefit, including priority, to U.S. Application No. 62/758,357, dated Nov. 9, 2018; and Canadian Application No. 3,027,897, dated Dec. 18, 2018, both entitled PRESENTATION CONTAINER APPARATUS, and both incorporated herein in their entirety by reference.

FIELD

The present disclosure relates to an apparatus for presentation or display.

INTRODUCTION

Transporting a delicate item, such as a cake, can be difficult. Cakes and the like are typically transported in boxes that are large enough to leave space around the cake, but care should be taken when removing the cake from the box to avoid disturbing the icing. The inventors have determined a need for improved apparatus for transporting items such as cakes or other delicate items.

SUMMARY

One aspect provides a presentation container comprising a sheet of material comprising a base panel, a wall panel foldably connected to each edge of the base panel, and a lid tab foldably connected to an outer edge of each wall panel, and one or more ribbons attached to the sheet of material. Each wall panel is foldable perpendicular to the base panel such that a side edge of each wall panel is next to each adjacent wall panel, and each lid tab is foldable perpendicular to the associated wall panel to place the container in a constructed form for housing an object in an interior thereof. At least two ends of the one or more ribbons are securable to each other to hold the container in the constructed form, and the container is moveable into a presentation form by unsecuring the at least two ends of the one or more ribbons to display the object.

In another aspect, there is provided another example of a presentation container. The container comprising a sheet of material, and one or more ribbons attached to the sheet of material. The sheet of material comprises a base panel having a first, a second, a third and a fourth edge, a first wall panel foldably connected to the first edge of the base panel, a second wall panel foldably connected to the second edge of the base panel, a third wall panel foldably connected to the third edge of the base panel, a fourth wall panel foldably connected to the fourth edge of the base panel, a first lid tab foldably connected to an outer edge of the first wall panel, a second lid tab foldably connected to an outer edge of the second wall panel, a third lid tab foldably connected to an outer edge of the third wall panel, and a fourth lid tab foldably connected to an outer edge of the fourth wall panel. Each wall panel is foldable perpendicular to the base panel such that a side edge of each wall panel is next to each adjacent wall panel, and each lid tab is foldable perpendicular to the associated wall panel to place the container in a constructed form for housing an object in an interior thereof. At least two ends of the one or more ribbons are securable to each other to hold the container in the constructed form. The container is moveable into a presentation form by unsecuring the at least two ends of the one or more ribbons to display the object.

Further aspects and details of example embodiments are set out below.

DESCRIPTION OF THE DRAWINGS

The following figures set forth embodiments in which like reference numerals denote like parts. Embodiments are illustrated by way of example and not by way of limitation in the accompanying figures.

DETAILED DESCRIPTION

Figure 1:
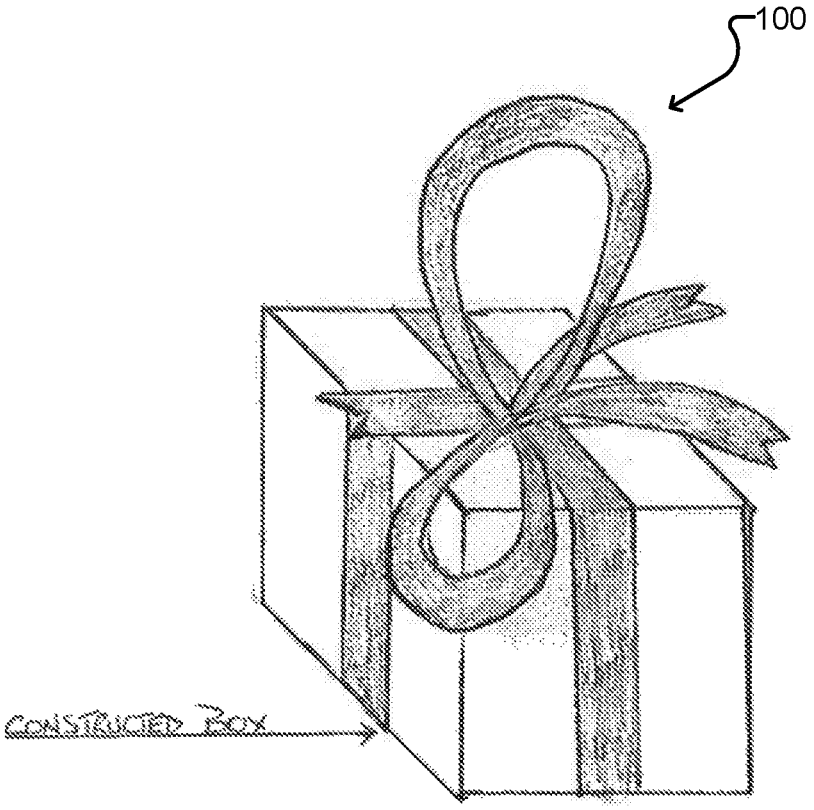
FIG. 1 shows an example apparatus in a constructed form.

The following describes an apparatus for transporting and presenting an item, such as a cake or other delicate item in an exciting and surprising manner.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 2:
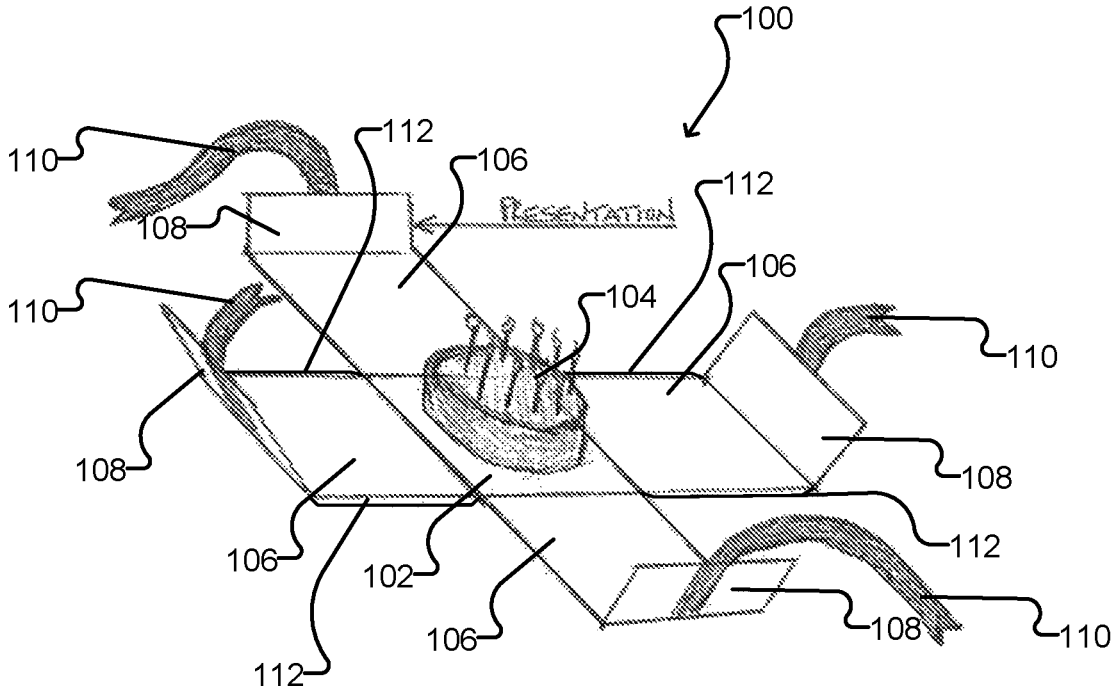
FIG. 2 shows an example apparatus in a presentation form.
Figure 3:
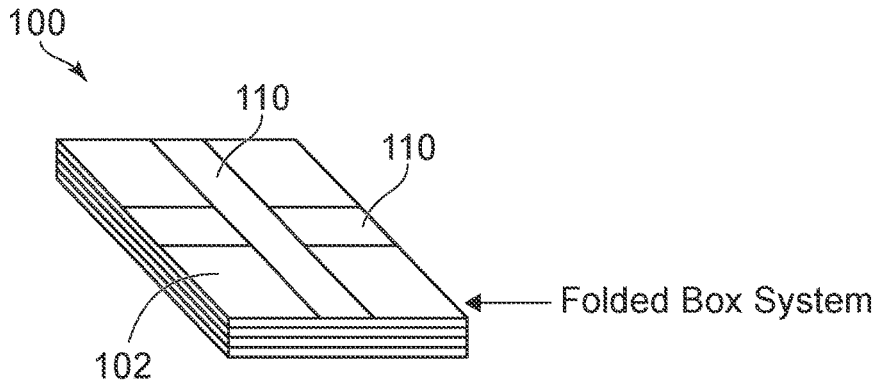
FIG. 3 shows an example apparatus in a folded form.

FIGS. 1-3 show a presentation container 100 according to one embodiment. FIG. 1 shows the container 100 in a constructed form, which is useful for transporting items; FIG. 2 shows the container 100 in presentation form, which is useful for displaying items; and FIG. 3 shows the container 100 in a folded form, which is useful for storing the container 100 when not in use. In some embodiments, the presentation container 100 in constructed form has an attractive appearance, like a wrapped gift, as shown in FIG. 1.

As best seen in presentation form shown in FIG. 2, the container 100 may be constructed from one piece of material, with a plurality of foldable panels. The material may be any light weight, flexible material, for example, cardboard or plastic. A base panel 102 of the presentation container 100 can hold an object 104, such as a cake, that may be transported using the container 100 in constructed form. The object 104 may be presented/displayed by moving the container 100 into presentation form. The edges of the base panel 102 are foldably connected to wall panels 106, and the wall panels 106 are foldably connected to lid tabs 108. In the illustrated example, the base panel 102 is rectangular, and there are four wall panels 106 and lid tabs 108. In other embodiments, the base panel 102 may have different shapes (e.g. hexagonal, with six wall panels and lid tabs), although a square or rectangular base panel 102 may provide increased strength and is less complicated for construction and setup. One or more ribbons 110 are attached to the container 100 (for example to the bottom of the base panel 102 and/or the outside of the wall panels 106) and extend beyond the lid tabs 108 to hold the container 100 in the constructed form as discussed further below. In some embodiments, ribbons 110 may comprise two ribbons 110 that cross over at the base panel 102. In some embodiments, ribbons 110 may comprise four ribbons, which may be attached to the base panel 102, or one may be attached to each wall panel 106, or one may be attached to each lid tab 108.

In some embodiments, the container 100 may include a removable support tray to securely hold a cake or other item. In some embodiments, the removable support tray may be shaped to fit the base of the container 100. In some embodiments, the removable tray may be shaped to securely hold a number of cupcakes or other smaller items.

In the constructed form, the wall panels 106 fold up perpendicular to the base panel 102 such that the edges of each wall panel 106 touch the edges of adjacent wall panels, and the lid tabs 108 fold perpendicular to the wall panels, toward each of the other tabs 108, such that the tabs 108 collectively form a lid for presentation container 100. The ribbons 110 may be tied to hold the container 110 in the constructed form, and/or may have adhesive material or fastening mechanism to hold the container in the constructed form, as described further below.

FIG. 3 shows the presentation container 100 in the folded form according to one embodiment. In folded form, the wall panels 106 are folded to be parallel to the base panel 102. The presentation container 100 may be used more than once. In folded form, the presentation container 100 is compact and flat for easy storage, marketing and consumer sales.

Figure 4:
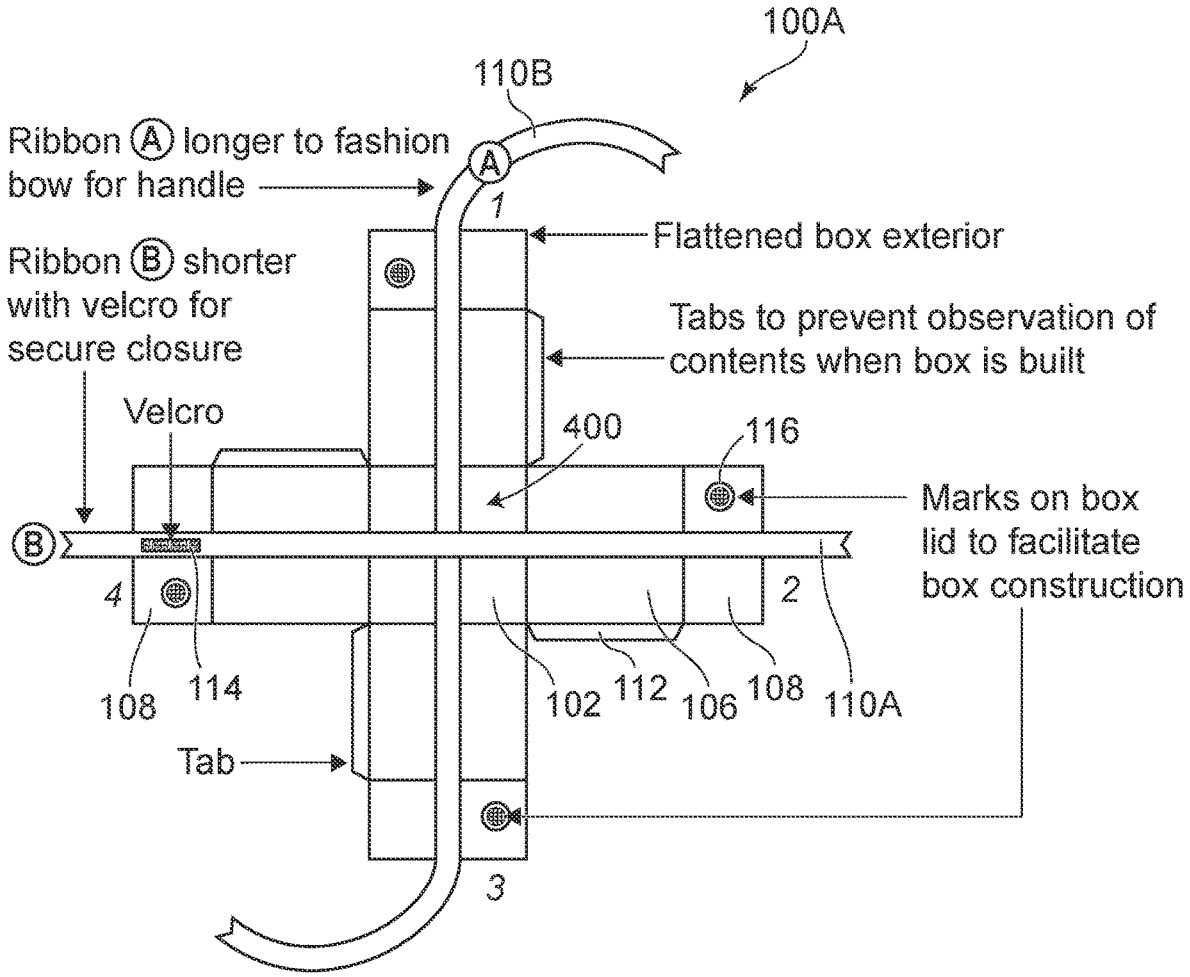
FIG. 4 shows the exterior side of an example apparatus in presentation form.
Figure 10:
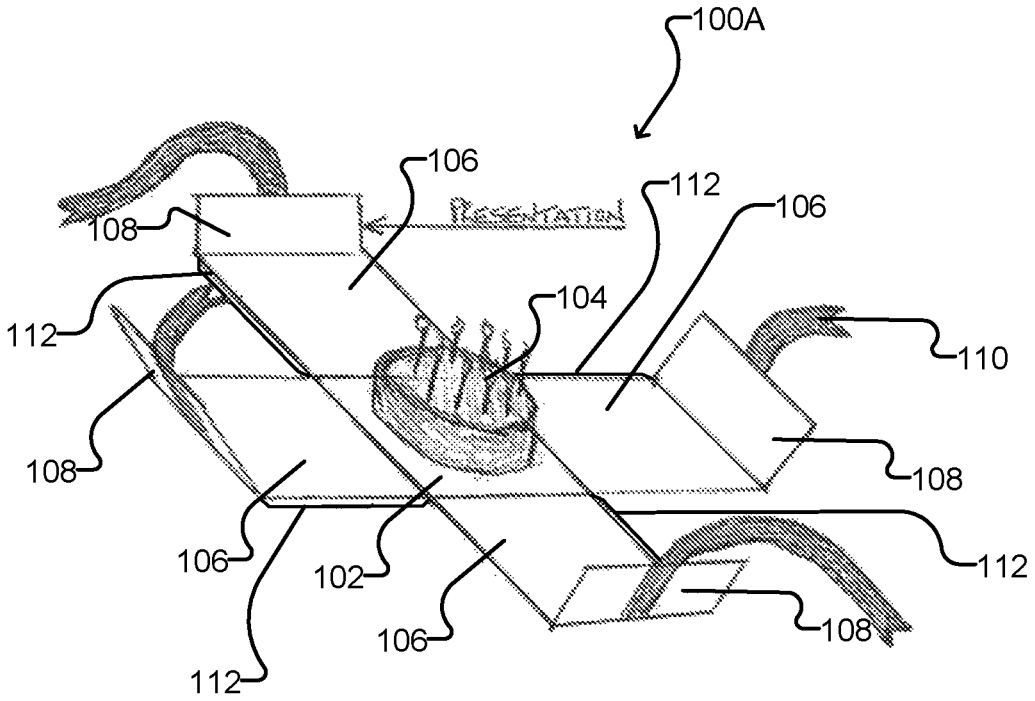
FIG. 10 shows another example apparatus in a presentation form.

FIG. 4 shows the exterior 400 (or bottom) of a presentation container 100A in presentation form according to one embodiment. The container 100A is the same as container 100 of FIGS. 1 to 3 except that each of the wall panels 106 has a side tab 112 to avoid gaps between the wall panels 106 when the presentation container 100 is in constructed form (to protect the object(s) inside and prevent observation). When the presentation container 100 is in constructed form, side tabs 112 fold inward from walls 106 to cover any space between the edges of wall 106 and adjacent walls. In the embodiment shown, each wall panel 106 is foldably connected to one side tab 112 on one side (as in the embodiment shown in FIG. 10). In some embodiments, two opposing wall panels 106 may each have two side tabs 112 (one on each side of the respective wall panel 106), while the other two opposing wall panels 106 do not have side tabs (as in the embodiment shown in FIG. 2). In some embodiments, none of the wall panels 106 have side tabs.

Figure 5:
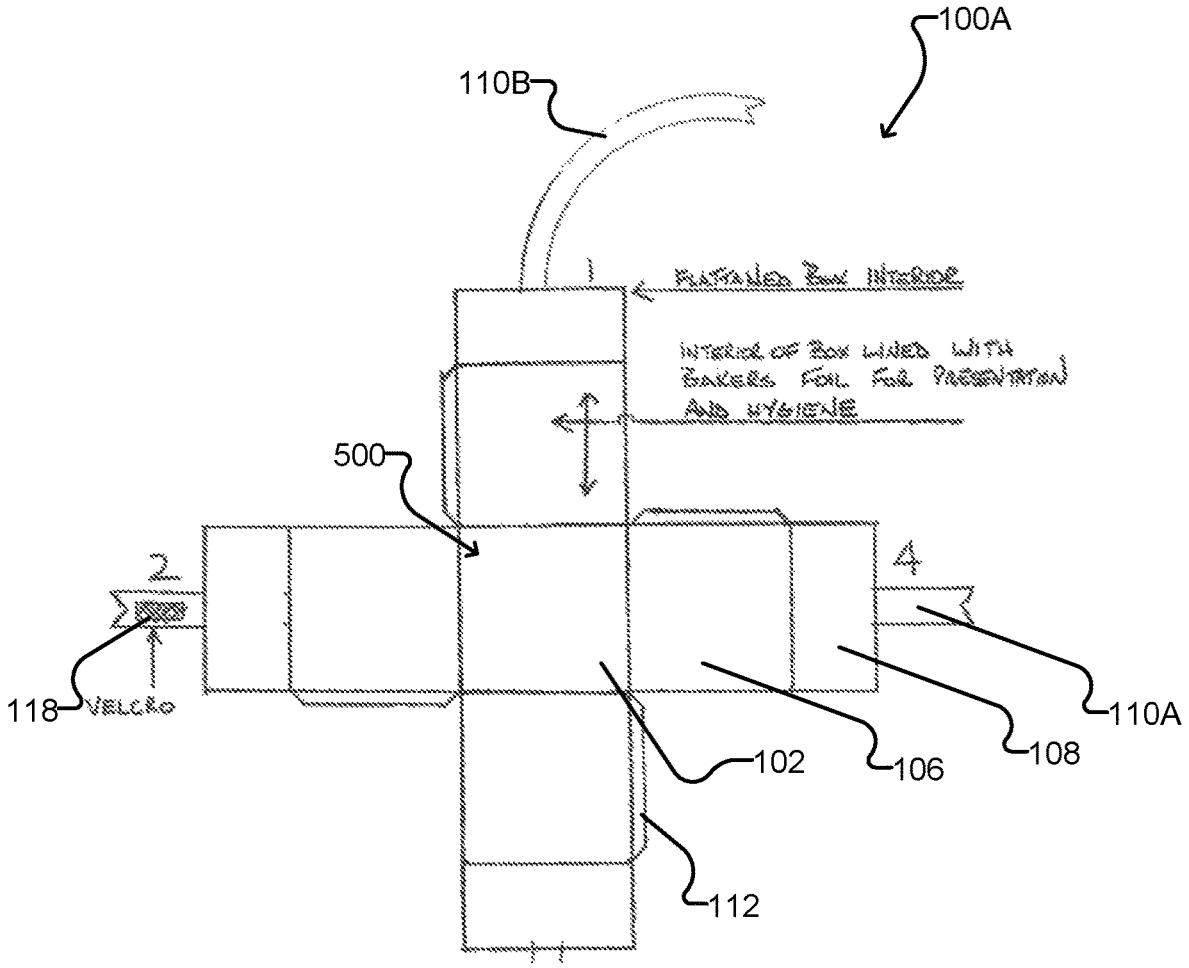
FIG. 5 shows the interior side of an example apparatus in presentation form.

FIG. 5 shows the interior 500 (or top) of the presentation container 100A of FIG. 4. In some embodiments, the interior 500 is lined for appearance and hygiene. For example, the interior 500 may be lined with fabric, for example, or may be lined with baker's paper or foil to facilitate wiping down any surface that gets icing or other material on it.

As shown in FIG. 4, each lid tab 108 may also have a mark 116 to assist a user in folding the presentation container 100 into constructed form. The mark 116 indicates which portion of each lid tab 108 is to be placed underneath a portion of an adjacent lid tab 108 in the constructed form of container 100. Marks 116 are on exterior 400 to help the user construct presentation container 100 into constructed form by making marks 116 disappear from view when in constructed form.

In the embodiment shown in FIGS. 4 and 5, the ribbons 110 are attached to the exterior 400 of the container 100A and comprise a first ribbon 110A and a second ribbon 1008 which cross over at the base panel 102, extend over the wall panels 106 and extend beyond the edges of each of the lid tabs 108. In this embodiment one end of the first ribbon 110A has an exterior piece of fastening material 114, and the other end of the first ribbon 110A has an interior piece of fastening material 118. Placement of exterior piece of fastening material 114 and interior piece of fastening material 118 on the first ribbon 110A keeps ribbon 110A centered when presentation container 100 is in constructed form, hiding the seams of the folds. The fastening material may, for example, comprise a hook and loop type fastener such as Velcro™. Alternately, the fastening material may comprise a re-usable adhesive material. The interior piece of fastening material 118 may be layered on top of the exterior piece of fastening material 114 when presentation container 100 is in constructed form, to form a secure closure. The second ribbon 1108 may be longer than the first ribbon 110A, such that the ends of the second ribbon 1108 may be tied together, for example in an aesthetically pleasing bow. By tying the ends of second ribbon 1108 together, this ensures the strength and integrity of presentation container 100 and forms a handle for carrying.

Figure 6:
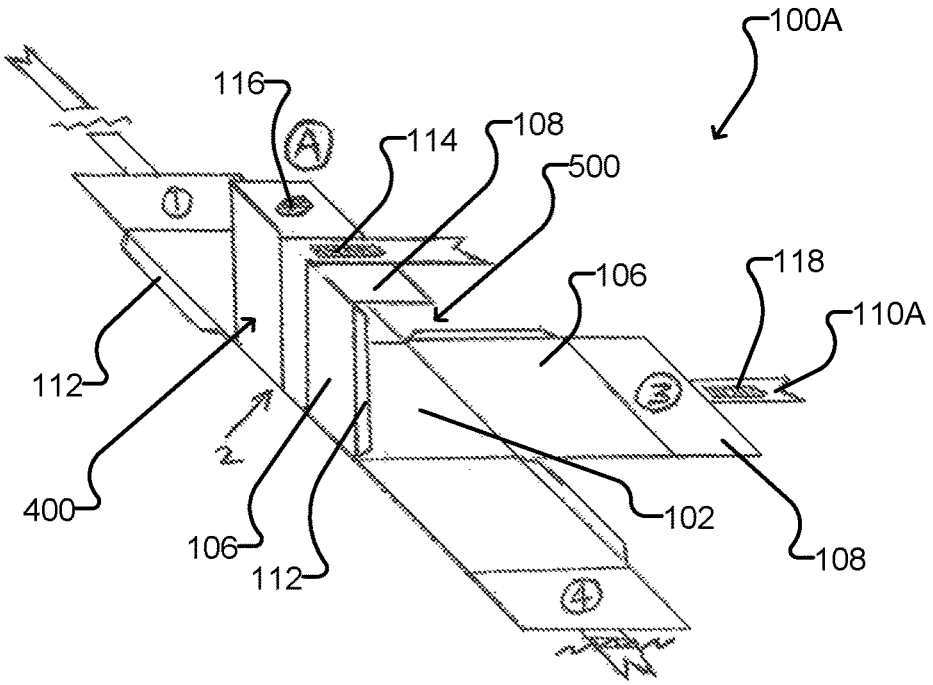
FIG. 6 shows an example apparatus in partially constructed form with one wall perpendicular to the base.

FIGS. 6-9 show the presentation container 100A in various stages between presentation and constructed forms according to one embodiment. FIG. 6 shows the container 100A with one wall panel 106 perpendicular to the base panel 102. In this embodiment, a first wall panel 106 and the ribbon 110A with the exterior piece of fastening material 114 is folded up. The side tab 112 is folded toward the interior 500. A first lid tab 108 is folded perpendicular to wall panel 106, such that exterior piece of adhesive material 114 is facing upward.

Figure 7:
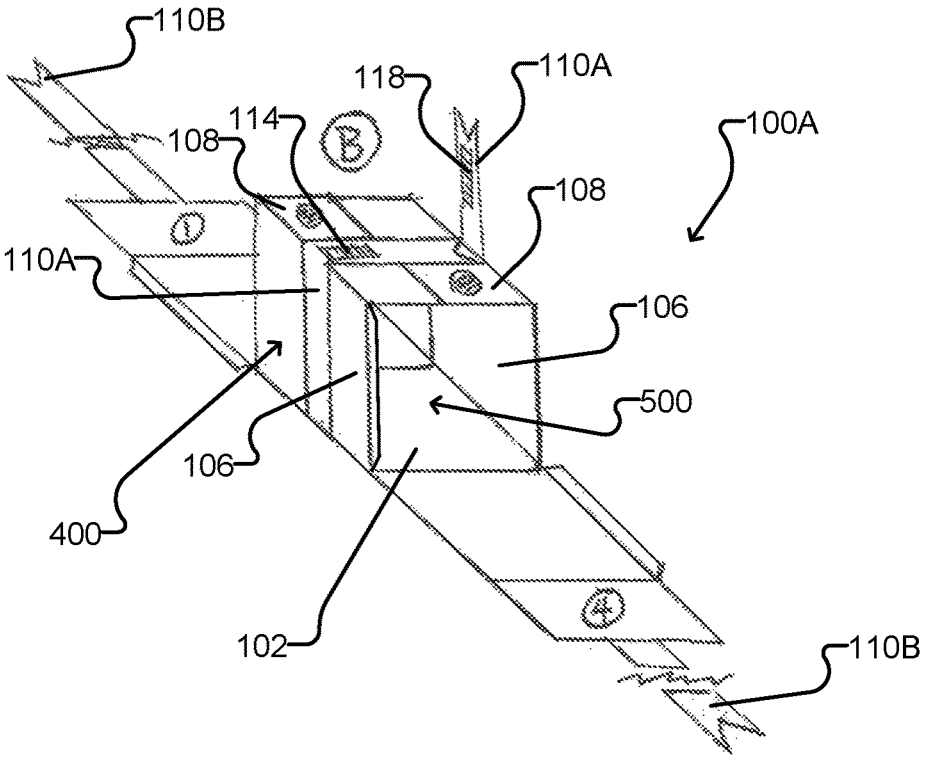
FIG. 7 shows an example apparatus in partially constructed form with two walls perpendicular to the base.

FIG. 7 shows the presentation container 100A in partially constructed form with two wall panels 106 perpendicular to the base 102. In this embodiment, a second wall panel 106 and the ribbon 110A with the interior piece of fastening material 118 is also folded up, with the side tab 112 folded inwardly. A second lid tab 108 is folded toward the first lid tab 108 such that the interior piece of fastening material 118 may be layered on top of exterior piece of fastening material 114 to form a secure closure. The ends of the ribbon 110A may not extend much, or at all, beyond lid tabs 108 in some embodiments.

Figure 8:
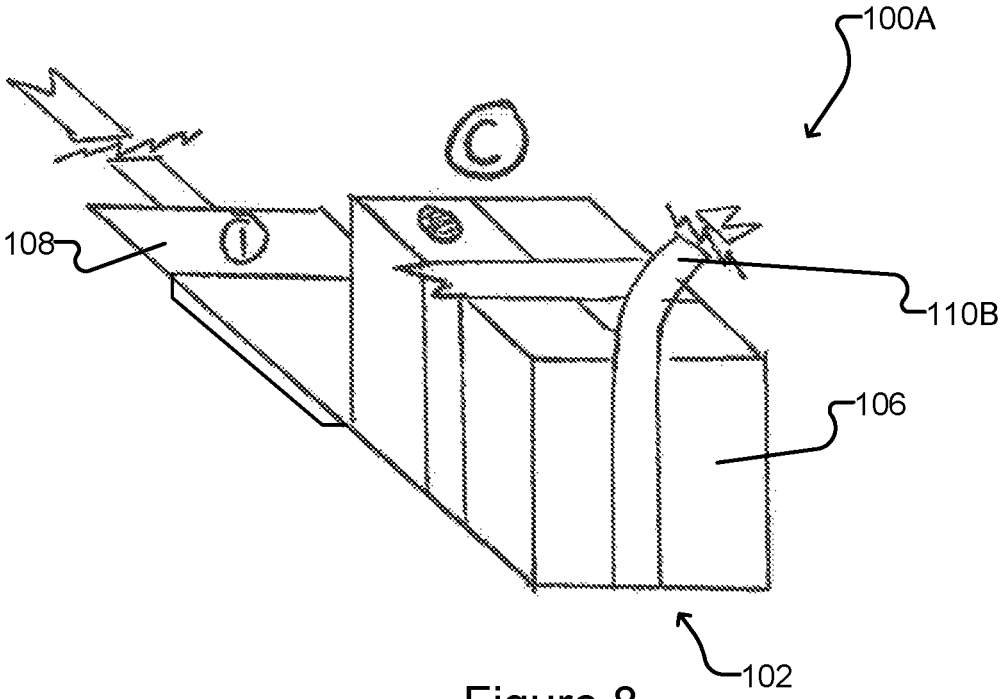
FIG. 8 shows an example apparatus in partially constructed form with three walls perpendicular to the base.

FIG. 8 shows the presentation container 100A in partially constructed form with three wall panels 106 perpendicular to the base. In this embodiment, a third wall panel 106 is folded up and perpendicular to base 102, with the side tab 112 folded inwardly. The third lid tab 108 fits under the adjacent lid tab 108 on one side and over the adjacent lid tab 108 on the other side. Marks 116 may provide assembly guidance to users. The fourth wall panel 106 is then likewise folded up, with the side tab 112 folded in and the fourth lid tab 108 fitted under and over adjacent lid tabs 108. In some embodiments, the center of each lit tab 108 abut at the top of the container 100 such that friction holds the lid tabs 108 together in a closed constructed form.

Figure 9:
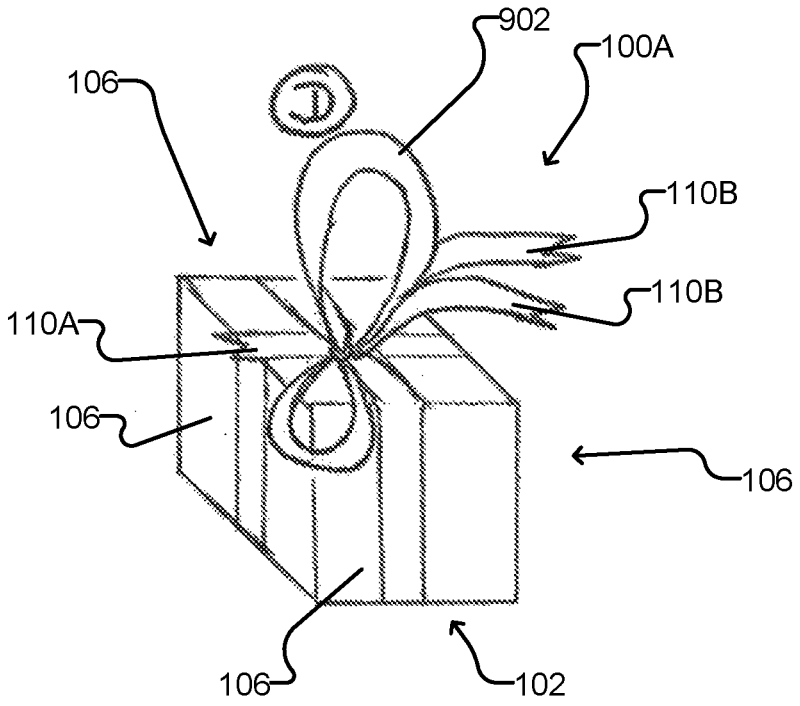
FIG. 9 shows an example apparatus in a constructed form.

FIG. 9 shows presentation container 100A in constructed form with all four walls 106 folded up perpendicular to base 102. The ends of the second ribbon 1108 may be tied to form loop 902 that may be used as a handle for carrying presentation container 100. The presentation container 100A may be rapidly disassembled into presentation form by untying ribbons 110, lifting interior piece of fastening material 118 off exterior piece of fastening material 114 and letting wall panels 106 fall to reveal the object 104. In some embodiments, the construction of the container 100 may be such that, when in constructed mode, the integrity of the material will hold the container 100 in constructed mode due to friction of the lid tabs 108. In such scenarios, the presentation container 100A may be disassembled into presentation form by untying ribbons 110, lifting interior piece of fastening material 118 off exterior piece of fastening material 114, and separating the abutting centers of each lid tabs 108 until the friction holding the lid tabs 108 in a closed constructed form becomes less than the force of gravity pulling the panel walls 106 downwards into the presentation form.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various example embodiments described herein.

The description provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As will be apparent to those skilled in the art in light of the foregoing disclosure, many alterations and modifications are possible to the methods and systems described herein. While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as may reasonably be inferred by one skilled in the art. The scope of the claims should not be limited by the embodiments set forth in the examples, but should be given the broadest interpretation consistent with the foregoing disclosure.

The present disclosure may be embodied in other specific forms without departing from its spirit or essential characteristics. The described embodiments are to be considered in all respects only as illustrative and not restrictive.

The invention claimed is:

1. A presentation container comprising:

a sheet of material comprising:

a base panel having a first edge, a second edge, a third edge and a fourth edge;

a first wall panel foldably connected to the first edge of the base panel;

a second wall panel foldably connected to the second edge of the base panel;

a third wall panel foldably connected to the third edge of the base panel;

a fourth wall panel foldably connected to the fourth edge of the base panel;

a first lid tab foldably connected to an outer edge of the first wall panel;

a second lid tab foldably connected to an outer edge of the second wall panel;

a third lid tab foldably connected to an outer edge of the third wall panel; and a fourth lid tab foldably connected to an outer edge of the fourth wall panel; and two or more ribbons attached to the sheet of material;

wherein the container is transformable into the constructed form when each wall panel is folded perpendicular to the base panel such that a side edge of each wall panel is next to a side edge of an adjacent wall panel, and each lid tab is folded perpendicular to its respective foldably connected wall panel;

wherein ends of the two or more ribbons are securable to each other to prevent falling of each wall panel to hold the container in the constructed form; and wherein the container is transformable into a presentation form when the ends of the two or more ribbons are unsecured, causing the wall panels and respective connected lid tabs to fall open and expose an interior of the container.

2. The presentation container as claimed in claim 1, wherein each of the wall panels and lid tabs are further foldable such that each of the wall panels and lid tabs lie parallel to the base panel to place the container into a folded form.

3. The presentation container as claimed in claim 1, wherein one of:

each wall panel has a side tab foldably connected to a same side of the respective wall panel and configured to fold inward, such that the side tabs cover a space between that wall panel and an adjacent wall panel when said wall panels are folded to be perpendicular to the base panel; or two opposing wall panels each have a left side tab and a right side tab foldably connected thereto and configured to fold inward, such that the side tabs cover a space between that wall panel and an adjacent wall panel when said wall panels are folded to be perpendicular to the base panel.

4. The presentation container according to claim 1, wherein an interior surface of the presentation container is lined with at least one of:

a food safe material; or foil.

5. The presentation container as claimed in claim 1, wherein the e-Re-two or more ribbons comprise a pair of ribbons attached to at least one of:

an exterior surface of the base panel;

an exterior surface of one or more respective wall panels; or an exterior surface of one or more respective lid tabs.

6. The presentation container as claimed in claim 5, wherein the pair of ribbons comprise a first ribbon having an interior piece fastening material attached to an interior side of one end and an exterior piece of fastening material attached to an exterior side of an opposite end, and a second ribbon longer than the first ribbon wherein ends of the second ribbon are tieable together.

7. The presentation container as claimed in claim 1, wherein the base panel comprises one of:

a rectangular shape;

a square shape; or a hexagonal shape.

8. The presentation container as claimed in claim 1, wherein the lid tabs collectively form a lid for the container in the constructed form.

9. The presentation container as claimed in claim 1, wherein the two or more ribbons comprise at least one of an adhesive material or a fastening mechanism to hold the container in the constructed form.

10. The presentation container as claimed in claim 9, wherein the fastening material comprises at least one of:

a hook and loop fastener; or a reusable adhesive material.

11. The presentation container as claimed in claim 1, comprising marks on the exterior of the lid tabs indicating where corresponding lid tabs overlap in the constructed form.

12. The presentation container as claimed in claim 1, wherein the two or more ribbons are secured when the ends of the two or more ribbons are tied together, and the two or more ribbons are unsecured when the ends of the two or more ribbons are untied.

13. The presentation container as claimed in claim 1, wherein the two or more ribbons are secured when opposing ends of the two or more ribbons are fastened to one another using a fastening material, and the two or more ribbons are unsecured when the fastened ends of the two or more ribbons are separated apart.

14. The presentation container as claimed in claim 1, wherein the sheet of material comprises at least one of:

a light weight material;

a flexible material;

cardboard; or plastic.

15. The presentation container as claimed in claim 1, wherein:

the container is configured to conceal an object in the constructed form; and the container is configured to reveal the object in the presentation form.

16. The presentation container as claimed in claim 1, wherein:

the base panel comprises at least one additional edge; and the sheet of material comprises:

at least one additional wall panel foldably connected to the respective at least one additional edge of the base panel; and at least one additional lid tab foldably connected to the respective at least one additional wall panel at an opposite edge from the base panel.

17. The presentation container as claimed in claim 1, wherein when the at least two ribbons are unsecured, the wall panels fall towards a plane defined by the base panel.

18. The presentation container as claimed in claim 17, wherein the plane defined by the base panel includes a surface holding the container.

19. The presentation container as claimed in claim 1, wherein the wall panels and lid tabs are foldable to be parallel to the base panel such that the container is collapsed into a folded form for storage.

20. The presentation container as claimed in claim 19, wherein the at least one ribbon comprises a handle for the container when secured in the constructed form.

* * * * *